US006500212B1

(12) United States Patent
Rodrigues et al.

(10) Patent No.: US 6,500,212 B1
(45) Date of Patent: Dec. 31, 2002

(54) METHOD FOR REDUCING WRINKLES AND IMPROVING FEEL IN FABRICS

(75) Inventors: Klein A. Rodrigues, Signal Mountain, TN (US); Susanne Goodson, Warrington, PA (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 190 days.

(21) Appl. No.: 09/708,133

(22) Filed: Nov. 8, 2000

(51) Int. Cl.[7] ..... D06M 13/322
(52) U.S. Cl. ..... 8/186
(58) Field of Search ..... 8/115.7, 181, 186, 8/189, 194

(56) References Cited

U.S. PATENT DOCUMENTS 3,649,165 A * 3/1972 Cotton ..... 8/115.5
4,295,846 A * 10/1981 Petersen et al. ..... 8/186
5,965,466 A * 10/1999 Rodrigues et al. ..... 442/107

FOREIGN PATENT DOCUMENTS

WO WO 01/16262 3/2000

* cited by examiner

*Primary Examiner*—Gregory Delcotto
*Assistant Examiner*—Preeti Kumar
(74) *Attorney, Agent, or Firm*—Thomas F. Roland, Esq.

(57) ABSTRACT

The present invention is directed to a method for treating a material to impart wrinkle reduction and temporary crease resistance thereto, and improve feel. The method involves: applying to said material a solution of a treatment composition in an amount effective to impart temporary crease and stain resistance, said fabric treatment composition comprising a hydroxy urea or hydroxy amide compound; and allowing said treatment composition to dry at ambient temperature, wherein said hydroxy urea compound comprises one urea and at least one hydroxyl group and said hydroxy amide compound comprises at least one amide group and at least one hydroxyl group. The material treatment is useful in reducing wrinkles in clothing, improving the feel of fabrics, and increasing the moisture adsorbence and retention in natural and synthetic fabrics.

17 Claims, 4 Drawing Sheets

Picture A

Picture A
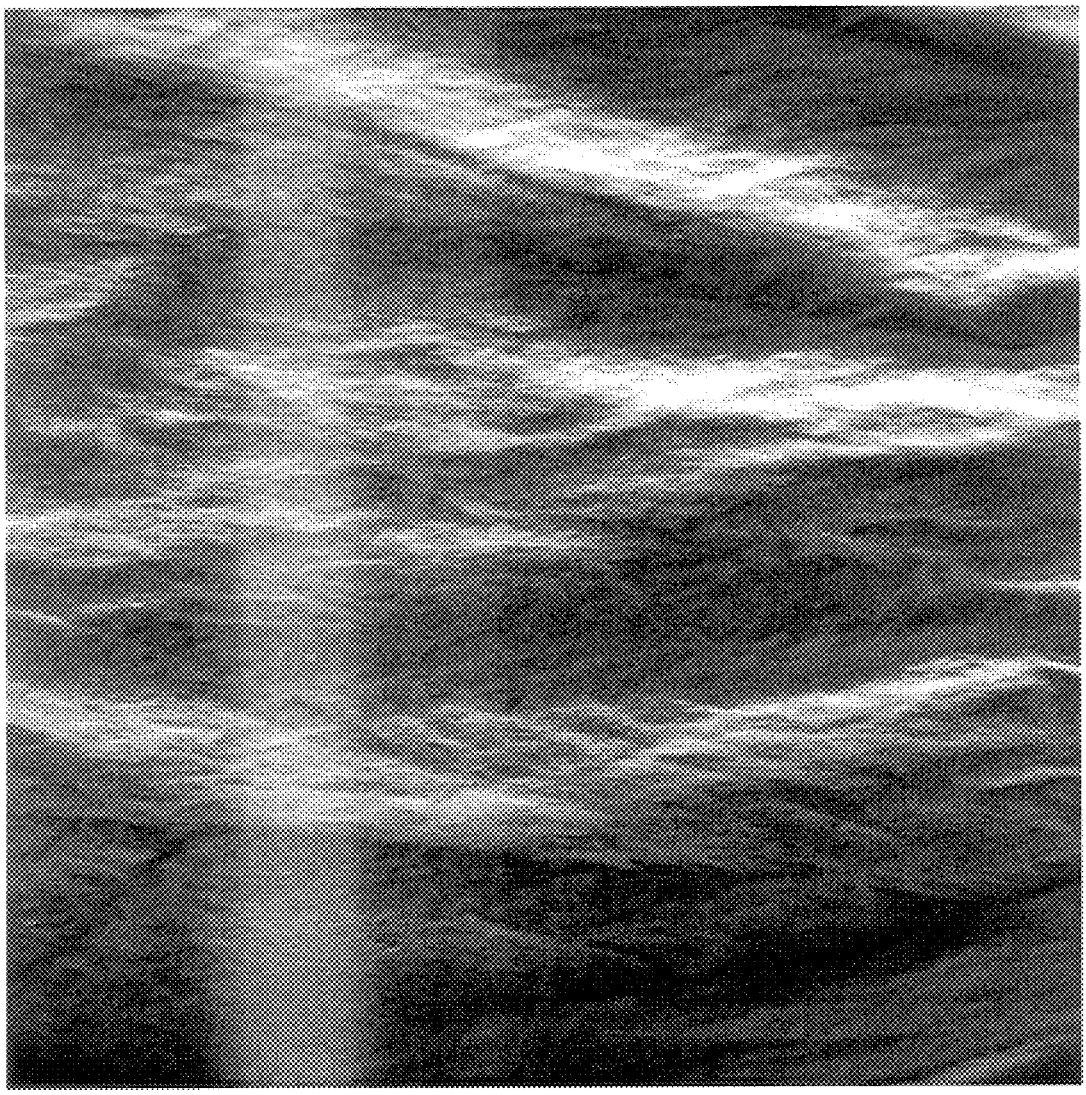

Picture B
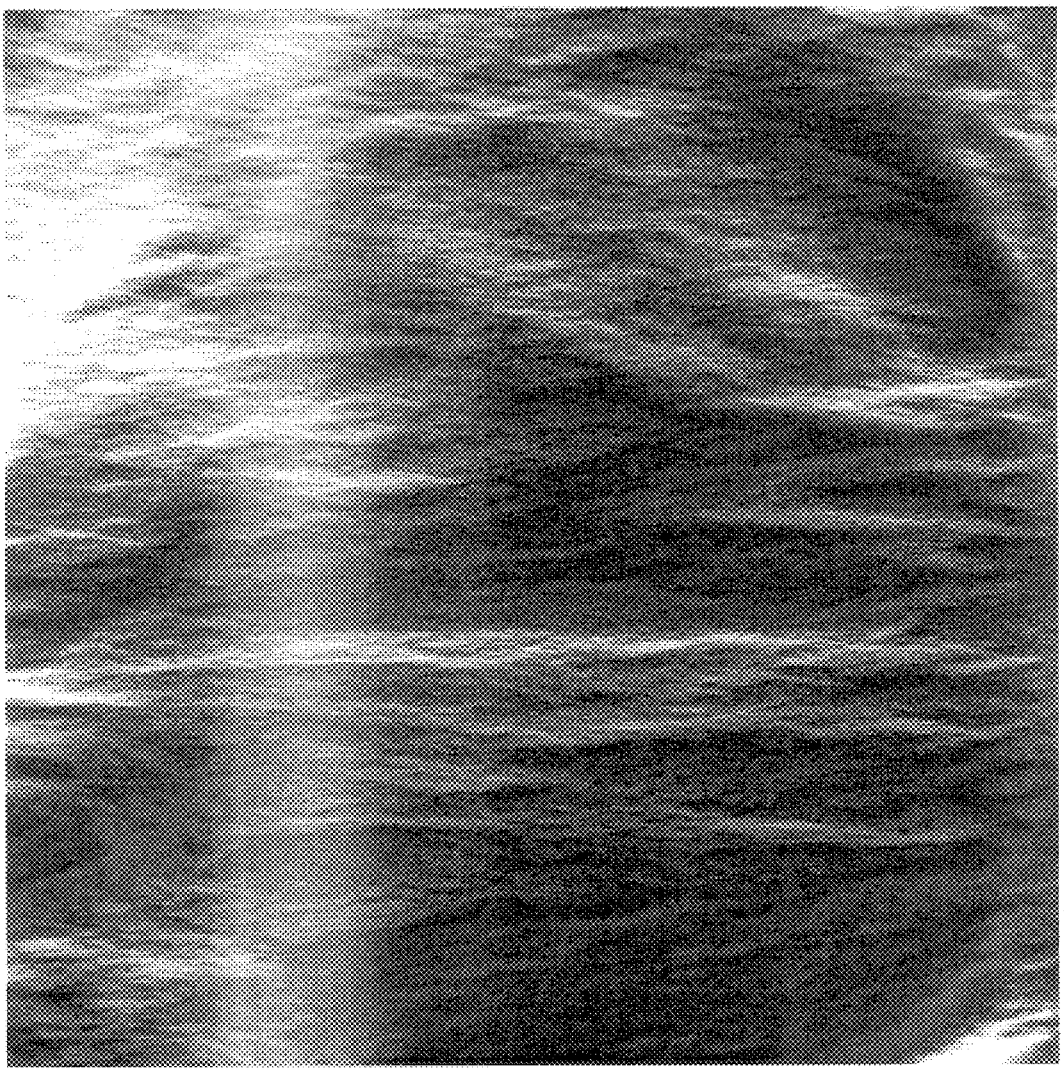

Picture C
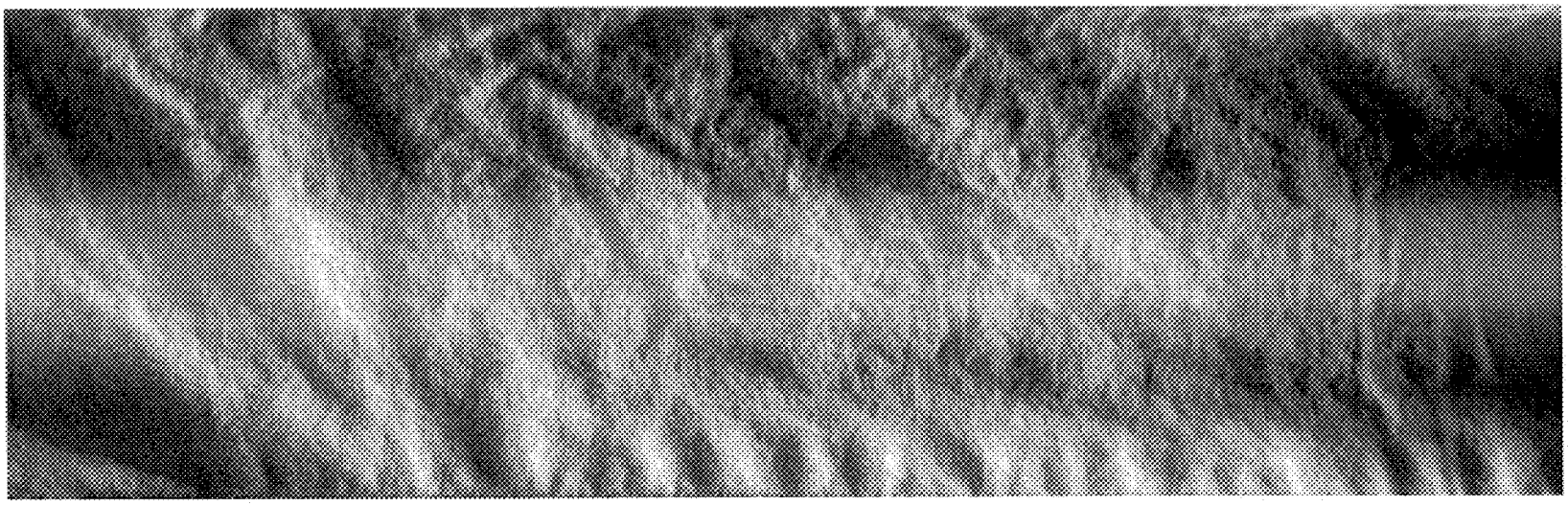

Picture D
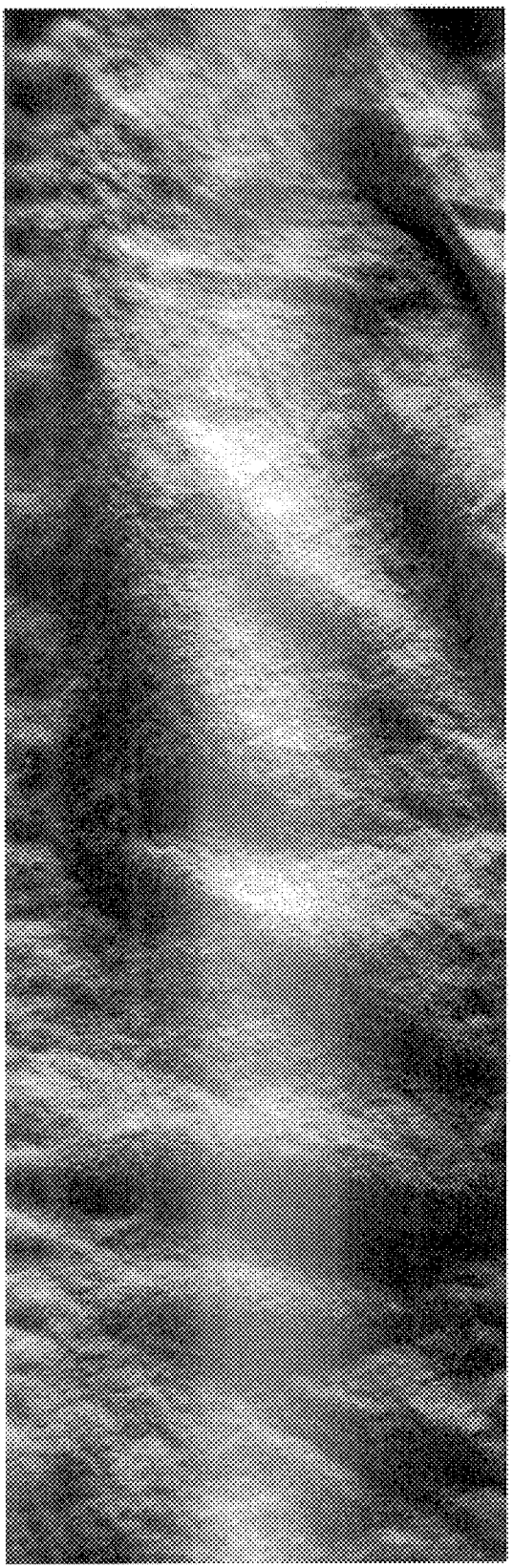

METHOD FOR REDUCING WRINKLES AND IMPROVING FEEL IN FABRICS

FIELD OF THE INVENTION

The present invention relates to the use of a treatment composition comprising a hydroxy urea or hydroxy amide compound in the treatment of a material to reduce wrinkles, impart temporary crease resistance and improve fabric hand (feel), and increase moisture absorbance. More specifically, the method of the invention involves applying a solution of the hydroxy compound to a material, and allowing the material to dry at ambient temperature, without the application of an external heat source.

BACKGROUND OF THE INVENTION

Clothing, fabric, and other materials, free of wrinkles are viewed in a more favorable light than the same materials that are wrinkled. Thus there have been many methods developed to reduce wrinkles on clothing and other materials, and to develop materials resistant to wrinkling. The use of thermosetting resins or reactants to impart crease resistance and dimensional stability to textile materials is well-known in the art. These materials, known as "aminoplast resins", include the products of the reaction of formaldehyde with such compounds as urea, thiourea, ethylene urea, dihydroxyethylene urea, melamines or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

The presence of even less than one percent of free formaldehyde, based on the total weight of the product, is undesirable, not only because of its unpleasant odor, but because it is an allergen and an irritant, causing severe reactions in the operators who manufacture the agent and who treat and handle the treated fabrics and to persons who handle and wear garments fabricated from the treated fabrics.

Solutions containing lubricants such as silicone compounds are known to reduce interfiber friction, allowing fibers to slide past each other and thereby reducing wrinkling. Such compounds are described in the art such as in U.S. Pat. No. 5,968,404, and in WO 11/24857.

U.S. Pat. No. 5,879,749 describes compositions containing a poly-functional molecule having at least two functional groups selected from carboxyl, anhydride and amine which is crosslinked using a (hydroxyalkyl)urea crosslinking agent. U.S. Pat. No. 5,965,466 describes the use of hydroxyalkyl urea and/or β-hydroxyalkylamide for imparting permanent press properties to a textile containing cellulose fibers. U.S. Pat. No. 4,076,917 describes β-hydroxyalkylamides as curing agents for polymers containing one or more carboxy or anhydride functions. These references require a heating step following application of the composition to the fabric, in order to effect a cross-linking reaction.

Treating textiles with resin compositions that do not contain or evolve formaldehyde is also known, as in U.S. Pat. No. 3,260,565 which describes finishing agents formed by the reaction of alkyl or aryl ureas or thioureas with glyoxal. U.S. Pat. Nos. 4,332,586 and 4,300,898 describe alkylated glyoxal/cyclic urea condensates as crosslinking agents for textiles. U.S. Pat. No. 4,295,846 describes a finishing agent for textiles which is prepared by reacting urea or symmetrically disubstituted ureas in an aqueous solution with glyoxal. These agents, however, have the disadvantage of having marginal permanent press properties. Finishing agents formed by the reaction of ethylene urea with glyoxal are described in Japanese publication No. 5 3044-567, but they too do not have satisfactory properties.

Copending U.S. application Ser. No. 09/456,358 describes a textile antiwrinkling composition containing polyhydroxyalkyl urea crease resistance agents having at least two urea moities.

There is a need for a material treatment composition which can be applied to a material to reduce wrinkles and impart temporary permanent press properties, without the need to follow the application with the addition of an external heat source. Ideally the treatment composition should be one which does not emit formaldehyde. Surprisingly, it has been found that a hydroxy urea or hydroxy amide compound, when applied to a fabric by means such as a spray, will reduce wrinkles, without the need for the addition of an external heat source. This method provides consumers the ability to provide crease resistance properties easily and cost-effectively to clothing at home, and even the ability to reduce wrinkles on clothing being worn. Furthermore, there is a need for anti-wrinkling treatments that do not discolor the fabric. Additionally the treatment should not negatively impact stain removal unlike the silicones that are difficult to clean because they attract oily stains. Finally, there is a need for a material that does not leave the fabric with an oily type of finish. The method of the present invention fulfills these needs.

SUMMARY OF THE INVENTION

The present invention relates to a method of treating a material which comprises applying to the material an amount of a treatment composition which is effective to impart temporary crease resistance. The treatment composition comprises a hydroxy compound which is either a hydroxy urea or a hydroxy amide. The material treatment composition may be applied to clothing, fabric, and textiles; and without the need of an external heat source, reduce wrinkles and provide the material temporary crease resistance. In addition, there is no build-up of the composition on clothes or irons, and no residual flaking is noted, even on dark fabric. The treated material also has a tactile sensation of feeling soft, and increased moisture absorbance. Moreover, there is no discoloration of the fabric and the material does not hold on to oily stains unlike the silicones typically used.

DESCRIPTION OF THE INVENTION

This invention relates to a method for imparting wrinkle reduction, permanent press properties, and improved feel, and increased moisture absorbance to a material. As used herein, "crease resistance" shall be synonymous with wrinkle resistance, durable press, dimensional stability, shrinkage resistance, and wrinkle recovery. The method involves applying a treatment composition of a hydroxy compound to a material, and allowing the material to dry at ambient temperature without application of an external heat source, to impart crease resistance properties to the material. The treatment composition is essentially free of formaldehyde and may be applied in the form of a solution or neat.

The material treated by the method of the present invention consists of a natural or synthetic material. The material may be a material such a leather, or a fibrous material.

Fibrous materials may be natural, synthetic, or a mixture thereof. Such material includes, but is not limited to, fabrics, textiles, non-wovens, and finished products made from these materials. The material preferably is a cellulosic fabric or textile, and may be woven or non-woven, and includes 100 percent cellulosic fabrics, for example, cotton, rayon, and linen, as well as blends, for example, polyester/cotton or polyester/rayon. The fibrous material may also be a non-cellulosic natural or synthetic fiber, such as for example nylon, silk, and polyester. Both white and colored (printed, dyed, yarn-dyed, cross-dyed, etc.) materials can be effectively treated with the material treatment composition of the present invention. The materials may comprise new or used clothing including previously worn clothing and/or laundered clothing.

The hydroxy compound is either a hydroxy urea or a hydroxy amide. The hydroxy urea useful in the present invention is one containing one urea functionality and at least one hydroxyl functionality. The term urea, as used herein, refers to a N—CO—N moiety in which the other two bonds on each nitrogen atom form additional attachments, as for example those found in the illustrations and examples herein. The urea and hydroxyl functionalities may be separated from each other in the compound by one carbon atom. Preferably they are separated by at least two carbon atoms. The hydroxy amide useful in the invention is one containing at least one amide functionality and at least one hydroxyl functionality. Preferably the hydroxy compound should not be a formaldehyde emitter. The preferred compounds of the invention are either a hydroxyalkyl urea, or a β-hydroxyalkyl amide, or a mixture thereof.

Preferred hydroxy urea compounds are derived from urea, and comprise only a single urea group, at least one hydroxyl group, at least two carbon atoms disposed between the urea group and each of the hydroxyl groups. The two carbons disposed between the hydroxyl and urea groups may be in linear, branched or substituted configuration. The hydroxy urea compound is represented by structure (I) as follows:

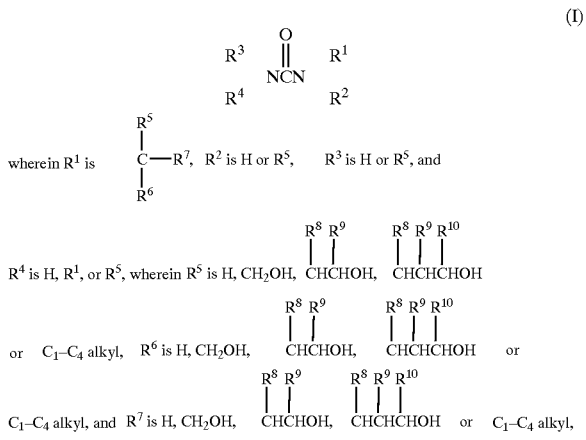

(I)

wherein $R^1$ is $-C(R^5)(R^6)-R^7$, $R^2$ is H or $R^5$, $R^3$ is H or $R^5$, and $R^4$ is H, $R^1$, or $R^5$, wherein $R^5$ is H, $CH_2OH$, $CH(R^8)CH(R^9)OH$, $CH(R^8)CH(R^9)CH(R^{10})OH$ or $C_1$–$C_4$ alkyl, $R^6$ is H, $CH_2OH$, $CH(R^8)CH(R^9)OH$, $CH(R^8)CH(R^9)CH(R^{10})OH$ or $C_1$–$C_4$ alkyl, and $R^7$ is H, $CH_2OH$, $CH(R^8)CH(R^9)OH$, $CH(R^8)CH(R^9)CH(R^{10})OH$ or $C_1$–$C_4$ alkyl, wherein $R^8$ is H, methyl or ethyl, $R^9$ is H, methyl or ethyl, and $R^{10}$ is H, methyl or ethyl.

Preferred hyroxy urea compounds are N-2-hydroxyethyl urea, N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea, N-methyl-D-glucourea, and 2-urea-2-ethyl-1,3-propanediol. Most preferably, the hydroxy urea compound is N,N'-bis(2-hydroxyethyl)urea. Combinations of hydroxy urea compounds can also be used in the method of the invention.

The hydroxy urea compound is the reaction product of urea and an alkanolamine with the evolution of ammonia. Preferred alkanolamines include, but are not limited to, diethanolamine, monoethanolamine, 2-amino-2-methyl-1,3-propanediol, bis(hydroxymethyl)amino-methane, 2-methyl-3-amino-1-propanol and 2-methylaminoethanol. Processes for preparing the hydroxy urea compound is described in U.S. patent application Ser. No. 08/783,350 which is hereby incorporated herein by reference.

Preferred hydroxy amide compounds are β-hydroxyalkyl amide compounds represented by structure (II) as follows:

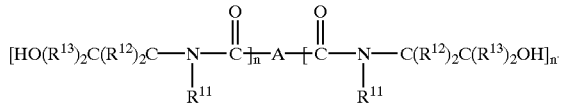

In structure (II), A is a bond, hydrogen or a monovalent or polyvalent organic radical derived from a saturated or unsaturated alkyl radical wherein the alkyl radical contains from 1 to 60 carbon atoms, such as methyl, ethyl, propyl, butyl, pentyl, hexyl, heptyl, octyl, nonyl, decyl, eicosyl, triacontyl, tetracontyl, pentacontyl, hexylcontyl and the like; aryl, for example, mono-and dinuclear aryl such as phenyl, naphthyl and the like; tri-lower alkyleneamino such as trimethyleneamino, triethyleneamino and the like; or an unsaturated radical containing one or more ethylenic groups such as ethenyl, 1-methylethenyl, 3-butenyl-1,3-diyl, 2-propenyl-1,2-diyl, carboxy lower alkenyl, such as 3-carboxy-2-propenyl and the like, lower alkoxy carbonyl lower alkenyl such as 3-ethoxycarbonyl-2-propenyl and the like; $R^{11}$ is hydrogen, lower alkyl of from 1 to 5 carbon atoms such as methyl, ethyl, n-propyl, n-butyl, sec-butyl, tert-butyl, pentyl and the like or hydroxy lower alkyl of from 1 to 5 carbon atoms such as hydroxyethyl, 3-hydroxypropyl, 2-hydroxypropyl, 4-hydroxybutyl, 3-hydroxybutyl, 2-hydroxy-2-methylpropyl, 5-hydroxypentyl, 4-hydroxypentyl, 3-hydroxypentyl, 2-hydroxypentyl and the isomers of pentyl; $R^{12}$ and $R^{13}$ are the same or different radicals selected from hydrogen, straight or branched chain lower alkyl of from 1 to 5 carbon atoms or one of the $R^{12}$ and one of the $R^{13}$ radicals may be joined to form, together with the carbon atoms, such as cyclopentyl, cyclohexyl and the like; n is an integer having a value of 1 or 2 and n' is an integer having a value of 0 to 2 or when n' is 0.

A preferred β-hydroxyalkyl amide compound is represented by structure (III) as follows:

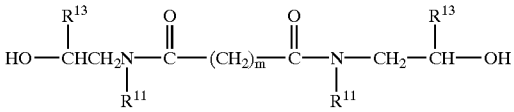

In structure (III), $R^{11}$ is H, lower alkyl, or $HO(R^{13})_2C(R^{12})_2C$—, n and n' are each 1, —A— is —$(CH_2)[m]$—, m is 0–8, preferably 2–8, each $R^{12}$ is H, and one of the $R^{13}$ radicals in each case is H and the other is H or a $C_1$–$C_5$ alkyl; that is wherein $R^{11}$, $R^{13}$, and m have the meanings just given. The most preferred β-hydroxyalkyl amide compound is represented by structure (IV) as follows:

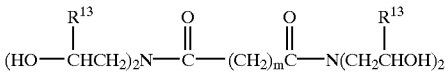

In structure (IV), $R^{13}$ is H or —$CH_3$.

Specific examples of β-hydroxyalkyl amide compounds are bis[N, N-di(beta-hydroxyethyl)] adipamide, bis[N,N-di(beta-hydroxypropyl)] succinamide, bis[N,N-di(beta-hydroxyethyl)] azelamide, bis[N-N-di(beta-hydroxypropyl)] adipamide, and bis[N-methyl-N-(beta-hydroxyethyl)] oxamide.

The β-hydroxyalkyl amide compounds are either known compounds or may be prepared by treating an ester with an amine at a temperature in the range of from about ambient to about 200° C. Suitable esters are prepared by esterifying the corresponding acid by standard esterifying procedures. Among the preferred acids used to prepare the β-hydroxyalkyl amide crosslinking agents are oxalic, malonic, succinic, glutaric, adipic, pimelic, suberic, azelaic, sebacic, 1,4-cyclohexane and the like and alkyl derivatives thereof. Dimer and trimer acids may also be used. Suitable amines used to prepare the β-hydroxyalkyl amide compounds are 2-aminoethanol; 2-methylaminoethanol; 2-ethylaminoethanol; 2-n-propylaminoethanol; 2,2'-iminodiethanol; 2-aminopropanol; 2,2'-iminodiisopropanol; 2-aminocyclohexanol; 2-aminocyclopentanol; 2-aminomethyl-2-methylethanol; 2-n-butylaminoethanol; 2-methylamino-1,2-dimethylethanol; 2-amino-2-methyl-1-propanol; 2-amino-2-methyl-1,3-propanediol; 2-amino-2-ethyl-1,3-propanediol and 2-amino-2-hydroxymethyl-1,3-propanediol. The β-hydroxyalkyl amide compounds are prepared according to processes described in U.S. Pat. No. 4,076,917 which is hereby incorporated herein by reference.

The treatment composition of the present invention can be used either in the neat form, or as a solution. A solution can be in any solvent which forms a solution or suspension with the hydroxy compound. Examples of useful solvents include, but are not limited to, water, acetone and alcohols such as methanol, ethanol, propanols and butanols, and mixtures of such solvents. A preferred solvent is water. An aqueous solution containing the hydroxy compound preferably has a pH of from about 1 to about 12, more preferably from about 2 to about 10, and most preferably from 4 to 7. Most preferably, an aqueous solution containing the hydroxy compound has a pH of from about 3 to about 8. It is understood that any means of adjusting the pH of the aqueous solution may be employed in the method of the invention to achieve a desired pH. When used in a solution form, the solution may contain other materials including, but not limited to, surfactants, buffers, dyes, polymers, and fragrance.

Any method of applying the treatment composition to the material is acceptable. Some examples of application methods include, but are not limited to, spray or mist application, application in the laundering process—especially in the rinse cycle, application from a sheet of material containing the treatment compound—for example in a dryer, and immersion in a solution containing the treatment composition.

A preferred method of applying the treatment composition to a material is by spray or mist application by means of a pump or aerosol, or other methods known in the art. One method, useful for individual use, is application from a spray or mist bottle. The treatment composition may be applied to clothing, which is being worn, as well as to clothing not being worn.

The material may be impregnated with an aqueous solution of the treatment composition. As used herein, "impregnate" refers to the penetration of the solution into the fiber matrix of the material, and to the distribution of the solution in a preferably substantially uniform manner into and through the interstices in the material. The solution therefore preferably envelopes, surrounds, and/or impregnates individual fibers substantially through the thickness of the material as opposed to only forming a surface coating on the material.

The treatment composition may be applied to the textile in a textile manufacturing process as part of the durable press finishing operation. Where the textile is not treated in a textile manufacturing process, the treatment composition may be applied in a laundering process, most preferably to rinse water in the rinse cycle of the laundering process at home or at a laundromat.

The treatment composition may also be transferred to the material to be treated through contact with another material impregnated with the treatment composition. An example would be the addition to a dryer or tumbling device of a sheet containing the treatment composition of the invention, and the transfer of the treatment composition to laundry through contact in the dryer. Since heat is not required for the method of the present invention, this method of application is useful on no-heat or low-heat settings.

Additionally, the treatment composition may be applied by soaking the textile in a solution containing the treatment composition.

The material treated with the treatment composition of the present invention is dried at ambient temperature, without the need for an external heat source. Application of an external heat source could speed the drying process, but is not required for the method of the present invention.

The hydroxy compound is present in an amount sufficient to provide about 0.00001 to about 10 percent of hydroxy compound in the material based on the oven-dry weight of the material. Preferably, the hydroxy compound is present in an amount sufficient to provide from about 0.1 to about 5 weight percent, and more preferably from about 0.5 to about 2 weight percent of hydroxy compound in the material based on the oven-dry weight of the material.

A dilute solution of the material is typically sprayed on to the fabric. The spray solution may contain 0.001 to 20 weight percent of the hydroxy urea compound, preferably 0.1 to 10 percent and most preferably 0.5 to 5 percent.

The method of the present invention provides crease resistance properties to materials treated therewith. Moreover, the treated textiles have a tactile sensation of feeling soft and retain their smoothness even after laundering.

The following nonlimiting examples illustrate further aspects of the invention.

EXAMPLE 1

106.2 g diethanolamine and 61.24 g urea were charged to a 250 mL flask equipped with a condenser, thermometer, stirrer, and nitrogen purge needle. The mixture was heated at 115° C. for 5 hours. A nitrogen purge was used to remove evolving ammonia. The progress of the reaction was monitored by titration of the remaining diethanolamine with 0.1 N hydrochloric acid. A clear hydroscopic liquid was obtained which contained N,N-bis(2-hydroxyethyl)urea.

EXAMPLES 2–7

The following amines were reacted with urea according to the procedure set forth in Example 1.

| Example | Amine | Wt, g | Urea g |
|---|---|---|---|
| 2 | Ethanolamine | 61 | 60 |
| 3 | 3-amino-1-propanol | 150 | 60 |
| 4 | 2-amino-2-ethyl-1,3-propanediol (AEPD) | 119 | 30 |
| 5 | Ethanolamine | 122 | 60 |
| 6 | Diethanolamine | 210 | 60 |
| 7 | 4-aminobutanol | 12 | 4 |

EXAMPLE 8

212.4 g diethanolamine in 212.4 g of water was neutralized with 101.85 g concentrated sulfuric acid to a pH of 4. A solution of 168.99 g potassium cyanate in 260 g of water was then added and the mixture was heated to 90° C. for 3 hours. After cooling to ambient temperature, potassium sulfate precipitated and was filtered out. The filter cake was washed with 425 g of hot ethanol. The recovered ethanol was then added to the contents of the filtrate, causing the filtrate to become cloudy. The white precipitate was removed by filtration and then the ethanol was removed by distillation to give a viscous liquid solution of N,N-bis(2-hydroxyethyl)urea. The product similarly could be obtained using other acids to neutralize the amine, e.g. sulfuric acid. Also, other cyanate salts could be used, e.g. sodium cyanate.

EXAMPLE 9

Following the procedure of Example 8, 195.22 g N-methyl-D-glucamine in 200 g water were reacted with 98.08 g sulfuric acid. After adjusting pH to 4, 81.11 g potassium cyanate was charged to the flask in 100 g water. The mixture was heated to 70° C. for 2 hours. After cooling to 0° C., the precipitated potassium sulfate byproduct was removed by filtration. The filtrate was treated with 250 mL of hot methanol and again filtered to remove any remaining salt byproduct. The methanol was then removed by vacuum distillation to give a solution containing N-methyl-D-glucourea.

EXAMPLE 10

Using the procedure set forth in Example 1, the reaction can also be conducted effectively using refluxing water as a means of removing evolving ammonia. 105 g diethanolamine, 25 g water, and 60 g urea were charged in a 250 mL flask equipped with heating mantle, stirrer, and thermometer and allowed to react at 115° C. for 8 hours.

EXAMPLE 11

210 g diethanolamine and 90 g dimethylcarbonate were charged to a flask with a heating mantle, stirrer, and condenser. The flask contents were heated to 80° C. and allowed to stir for 3 hours. Volatile byproducts, e.g., methanol, were removed by vacuum distillation. A mixture containing tetrakis(2-hydroxyethyl)urea was obtained.

EXAMPLE 12

To a solution of 106 g of diethanolamine in 700 mL of methanol was added a solution of 99 g of n-butylisocyanate in 40 mL of tetrahydrofuran over 1 hour, holding the temperature below 30° C. After the addition, the mixture was stirred for 1 hour and then the solvent was removed by vacuum distillation to give a white solid, N'-butyl-N,N-bis(2-hydroxyethyl)urea.

EXAMPLES 13–14

The following amines were reacted with an isocyanate according to the procedure set forth in Example 12.

| Example | Amine | Wt. (g) | Isocyanate | Wt. (g) |
|---|---|---|---|---|
| 13 | Ethanolamine | 61 | N-butyl isocyanate | 99 |
| 14 | N-methyl-D-glucoamine | 196 | N-butyl isocyanate | 99 |

EXAMPLE 15

A 500 mL flask equipped with stirrer and condenser was charged with 145.1 g of 40% glyoxal and 90 g of urea. The temperature was held at 30° C. for 6 hours. The resultant solution contained 4,5-dihydroxyimidazolidone.

EXAMPLE 16

Cotton swatches, 6" by 11" were sprayed with a solution of the Example compounds, such that $7\times10^{-4}$ moles of the material were delivered to the fabric. The swatches were allowed to dry overnight and then the wrinkle recovery was measured as in AATCC (American Association of Textile Chemists and Colorists) Test Method 128-1980. Instead of using the standard evaluation method found in section 6, a pairwise comparison of the wrinkled swatches was used. Less wrinkled swatches were given a score of 2, while the more wrinkled fabric was assigned a value of 1. When no difference in fabric appearance could be distinguished, a ranking of 1.5 was given to each swatch. The totals for each swatch were added together and called "rank sum". By this method, swatches with a higher rank sum were found to be less wrinkled by the panelists.

TABLE 1

| Example | Rank Sum (higher = less wrinkling) |
|---|---|
| 1 | 26 |
| 2 | 21 |
| Water | 15 |

EXAMPLE 17

Swatches 5" by 5" in size were sprayed with an aqueous solution of the Example materials to give the concentrations on the swatch as shown in Table 2. The swatches were conditioned in a dessicator kept at constant humidity level to equilibrate the samples. The humidity level was controlled by saturated salt aqueous solutions. After conditioning, the cloth samples were loaded into the TGA instrument at room temperature, equilibrated for half a minute at 25° C., then heated to 100° C. and held at 105° C. for 10 minutes. TGA measurements were conducted under ultra pure $N_2$. The instrument detected the sample weight loss in percentage of total starting sample weight. The experimental error was about 0.5. The weight loss was found to be due to water loss rather than to derivative decomposition. The total water loss is effectively the water uptake of the swatches at 100% relative humidity. The total water uptake is for each of the materials is shown in Table 2. Samples, which were treated with hydroxy urea materials, were shown to absorb more water than samples with no treatment.

TABLE 2

Moisturizing Effect of Hydroxy Ureas

| Material | Moles material/ gram swatch (moles/g) | Water Uptake 100% RH (% mass increase) |
|---|---|---|
| 1 | $5.11 \times 10^{-3}$ | 40.8 |
| 2 | $5.02 \times 10^{-3}$ | 42.9 |
| 9 | $5.38 \times 10^{-3}$ | 54.2 |
| 13 | $5.54 \times 10^{-3}$ | 33.9 |
| 14 | $5.15 \times 10^{-3}$ | 37.4 |
| 12 | $4.98 \times 10^{-3}$ | 31.7 |
| Water | 0 | 14.4 |

EXAMPLE 18

Fabric Feel

For the fabric feel test, 3% solutions were made of each of the following products; Example 1 (N,N-bis(2-hydroxy ethyl urea)), Example 2 (N-2-hydroxyethylurea) and Example 9 (N-methyl-D-glucourea). These solutions were sprayed for 10 seconds each onto 10 inch square swatches of cotton, 50/50 cotton polyester blend, and polyester. The swatches were then ironed dry. A panel was asked to evaluate the feel of the fabric by comparing each sample swatch to a blank swatch of the same fabric that had been sprayed with deionized water and ironed dry. Each individual decided if the sample felt better, worse or equal to the blank.

Results were tallied by allocating one point for a sample that felt better than the blank, deducting one point for a sample rated worse than the blank, and by giving zero points for samples that felt equivalent to the blank. Total points for each individual sample were then added together. Results appear in the chart below.

EXAMPLE 19

Wrinkle Release Method

Shirts were first prewashed in Tide powder and dried in the drier. Each shirt was then placed on a flat surface and one side was covered with paper. The uncovered side was sprayed with the following treatment solutions, 3% solution of N,N-bis(2-hydroxyethyl urea) (Example 1)

Water

Commercial Wrinkle reducing spray.

The paper was then removed and the shirt was pulled taught and smoothed to remove wrinkles. The shirt was then allowed to air dry. Pictures were taken of these shirts. The pictures listed below are of the (A) starting shirt (B) shirt treated with water (C) shirt treated with commercial wrinkle spray (D) 3% solution of N,N-bis(2-hydroxyethylurea) with water The pictures indicate that the hydoxy urea of this invention is superior to water or a commercial wrinkle reducing spray.

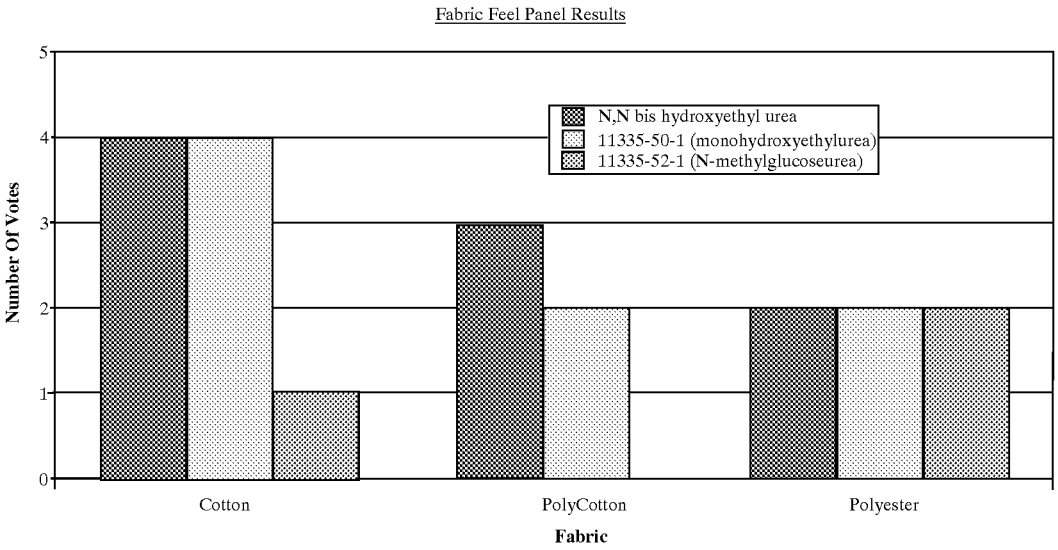

Example 1 and Example 2 when applied to cotton, received the most points (four each). Example 1 also received three points on polycotton and two on polyester. Example 2 received two points each on polycotton and polyester. Example 9 performed poorly receiving two votes for polyester, one point for cotton and zero points for polycotton.

In order to decide the best overall performer, the points for a single product's use on each of the individual fabrics were added together. Example 1 had the best overall rating with nine points. Example 2 followed closely behind with eight points. Example 9 received an overall rating of three points. The maximum number of points available was eleven. Following this evaluation, drops of water were placed on each sample and the rate of absorption was visually evaluated. There seemed to be no difference in the rate at which the water was absorbed by the various swatches but polyester samples ironed with Example 2 and Example 9 and Example 1 seemed to dry faster than the blank.

What is claimed is:

1. A method for treating a material to impart wrinkle reduction and temporary crease resistance thereto, and improve feel, comprising:

a) applying to said material a treatment composition in an amount effective to impart temporary crease and stain resistance, said fabric treatment composition comprising a hydroxy compound; and b) allowing said treatment composition to dry at ambient temperature wherein said drying step takes place without the application of an external heat source, wherein said hydroxy compound comprises either:

1) a hydroxy urea comprising one urea and at least one hydroxyl moiety; or 2) a hydroxy amide comprising at least one amide and at least one hydroxyl moiety.

2. The method of claim 1 wherein said hydroxy compound comprises a (hydroxyalkyl)urea, β-hydroxyalkylamide, or combinations thereof.

3. The method of claim 2 wherein a) said (hydroxyalkyl)urea has the structure

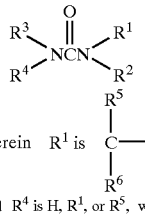

wherein $R^1$ is $C(R^5)(R^6)-R^7$, $R^2$ is H or $R^5$, $R^3$ is H or $R^5$, and $R^4$ is H, $R^1$, or $R^5$, wherein $R^5$ is H, $CH_2OH$, $CH(R^8)CH(R^9)OH$, $CH(R^8)CH(R^9)CH(R^{10})OH$ or $C_1$–$C_4$ alkyl, $R^6$ is H, $CH_2OH$, $CH(R^8)CH(R^9)OH$, $CH(R^8)CH(R^9)CH(R^{10})OH$ or $C_1$–$C_4$ alkyl, and $R^7$ is H, $CH_2OH$, $CH(R^8)CH(R^9)OH$, $CH(R^8)CH(R^9)CH(R^{10})OH$ or $C_1$–$C_4$ alkyl, wherein $R^8$ is H, methyl or ethyl, $R^9$ is H, methyl or ethyl, and $R^{10}$ is H, methyl or ethyl; and b) said β-hydroxyalkylamide has the structure

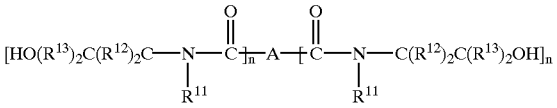

wherein A is a bond, hydrogen, a monovalent or polyvalent organic radical derived from a saturated or unsaturated alkyl containing from 1 to 60 carbon atoms, aryl, tri-lower alkyleneamino or an ethylenically unsaturated radical; $R^{11}$ is selected from the group consisting of hydrogen, lower alkyl having 1 to 5 carbon atoms, and hydroxyalkyl having from 1 to 5 carbon atoms; $R^{12}$ and $R^{13}$ are independently selected from the group consisting of hydrogen, straight or branched chain lower alkyl having from 1 to 5 carbon atoms, and one of the $R^{12}$ and $R^{13}$ radicals joined together with the carbon atoms to which they are attached to form a cycloalkyl; n is an integer of 1 or 2 and n' is an integer of 0 to 2; n being 2 when n' is 0.

4. The method of claim 1 wherein said material comprises a natural or synthetic material.

5. The method of claim 4 wherein said material is selected from the group consisting of cotton, rayon, linen, leather, silk, polyester/cotton, polyester/rayon, and combinations thereof.

6. The method of claim 2 wherein said hydroxy compound is selected from the group consisting of N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea, 2-urea-2-ethyl-1,3-propanediol, N-hydroxyethylurea, N-methyl-D-glocourea, and combinations thereof.

7. The method according to claim 2 wherein said β-hydroxyalkylamide has the structure

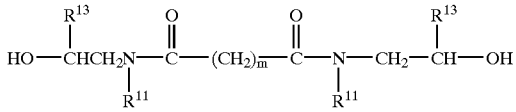

wherein m is 0 to 8; $R^{11}$ is selected from the group consisting of hydrogen, lower alkyl having 1 to 5 carbon atoms, and hydroxyalkyl having from 1 to 5 carbon atoms; and $R^{13}$ is selected from hydrogen or straight or branched chain lower alkyl having from 1 to 5 carbon atoms.

8. The method according to claim 7 wherein said β-hydroxyalkylamide has the structure

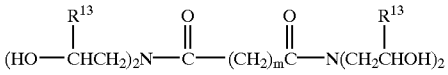

wherein $R^{13}$ is hydrogen or methyl.

9. The method according to claim 2 wherein said β-hydroxyalkylamide is selected from the group consisting of bis[N,N-di(beta-hydroxyethyl)] adipamide, bis[N,N-di(beta-hydroxypropyl)] succinamide, N-2-hydroxyethylurea, bis[N,N-di(beta-hydroxyethyl)] azelamide, bis[N-N-di(beta-hydroxypropyl)] adipamide, and bis [N-methyl-N-(beta-hydroxyethyl)] oxamide.

10. The method according to claim 1 wherein the hydroxy compound is present in an amount sufficient to provide from about 0.00001 to about 10 weight percent of hydroxy compound in the material based on the oven-dry weight of the material.

11. The method according to claim 10 wherein the concentration of the hydroxy compound is present in an amount sufficient to provide from about 0.1 to about 5 weight percent of (hydroxyalkyl)urea or β-hydroxyalkylamide in the textile based on the oven-dry weight of the textile.

12. The method of claim 1 wherein said treatment composition is applied as a solution.

13. The method according to claim 12 wherein the treatment composition is applied to the material by means of a spray or mist.

14. The method according to claim 12 wherein said solution has a pH of from about 1 to about 10.

15. The method according to claim 14 wherein said solution has a pH of from about 2 to about 7.

16. The method according to claim 15 wherein said solution has a pH of from about 3 to about 5.

17. A method for increasing the feel, and moisture absorption and retention of a material comprising:

b) applying to said material a treatment composition in an amount effective to impart temporary crease and stain resistance, said fabric treatment composition comprising a hydroxy compound; and c) allowing said treatment composition to dry at ambient temperature, wherein said drying step takes place without the application of an external heat source, wherein said hydroxy urea compound comprises either:

1) a hydroxy urea comprising one urea and at least one hydroxyl moiety; or 2) a hydroxy amide comprising at least one amide and at least one hydroxyl moiety.

* * * * *